United States Patent [19]

McCarthy

[11] Patent Number: 5,056,281

[45] Date of Patent: Oct. 15, 1991

[54] BASEWRAP FOUNDATION WALL INSULATION AND DRAINAGE

[75] Inventor: Grant McCarthy, Gibbons, Canada

[73] Assignee: 501 Beaver Plastics, Ltd., Edmonton, Canada

[21] Appl. No.: 539,213

[22] Filed: Jun. 18, 1990

[30] Foreign Application Priority Data

Jun. 22, 1989 [CA] Canada ..... 603561

[51] Int. Cl.[5] ..... E02D 31/02

[52] U.S. Cl. ..... 52/169.5; 405/45

[58] Field of Search ..... 405/45; 52/302, 303, 52/169.5, 169.14

[56] References Cited

U.S. PATENT DOCUMENTS

| | | | |
|---|---|---|---|
| 4,309,855 | 1/1982 | Pate . | |
| 4,318,258 | 3/1982 | Heck | 52/309.12 |
| 4,704,048 | 11/1987 | Ahlgrimm | 52/169.5 |

FOREIGN PATENT DOCUMENTS

| | | | |
|---|---|---|---|
| 881237 | 9/1971 | Canada . | |
| 1001863 | 12/1976 | Canada . | |
| 1055263 | 5/1979 | Canada . | |
| 1156896 | 4/1983 | Canada . | |
| 1158054 | 12/1983 | Canada . | |
| 1199188 | 1/1986 | Canada . | |
| 1202190 | 3/1986 | Canada . | |
| 1220041 | 4/1987 | Canada . | |
| 1229993 | 12/1987 | Canada . | |
| 1249135 | 1/1989 | Canada . | |
| 2394647 | 2/1979 | France | 52/309.12 |

*Primary Examiner*—John E. Murtagh

*Attorney, Agent, or Firm*—Richard C. Litman

[57] ABSTRACT

A unique one-piece molded insulating and drainage panel for use for basement subterannean walls is disclosed. The panel is molded from expanded polystyrene having very low water permeability. When installed, the panel has two sides having vertically oriented grooves on both sides. The grooves abutting the foundation wall are typically rectangular whereas the vertical channels on the outside wall are specifically designed to be self-clearing to avoid blockage by backfill. Typically a bell-bottom shaped narrow opening and a wider inner channel is used.

3 Claims, 2 Drawing Sheets

BASEWRAP FOUNDATION WALL INSULATION AND DRAINAGE

FIELD OF THE INVENTION

This invention relates to insulation products for exterior basement subterranean walls and foundations and, more particularly, relates to insulating materials providing drainage. Whenever structures are built below ground, and in particular with concrete or block foundation walls, two problems are encountered.

The first problem is that the wall tends to act as a heat conductor and basements are typically cold taking on the outside temperature of the surrounding soil.

A second problem is that of ground water which under pressure tends to force its way through cracks and pores of the concrete or blocks creating a damp inner dwelling space.

BACKGROUND OF THE INVENTION

First attempts to correct these two problems involved insulating the inside of the basement walls and covering the outer exterior foundation walls with some sort of bituminous or tar-like substance. Nevertheless, moisture tended still to penetrate these walls through cracks in the covering and because of the pressure of the surrounding water. Typically, drainage of ground water is accomplished by using a perforated pipe around the foundation which is surrounded by an aggregate substance such as gravel, the pipe leading off to some sort of drain.

More recently, it has been found that exterior insulation is more effective in preventing heat transfer from the surrounding ground into the dwelling or building. Also, it has been found that by using various materials with vertically oriented grooves or channels, water drainage to the footing is obtained by the channels or spaces. In the past, various attempts have been made to combine both insulating and drainage properties by using expanded polystyrene in various formations and configurations.

The product must be porous enough to provide sufficient insulating qualities but yet have sufficient compressive strength to resist crushing or deformation by ground fill and ground water pressure. The most significant problem which has plagued the new products is that caused by clogging of the vertically directed drainage channels by the backfill. Although proper backfill such as course aggregate should be used, today's high labour cost construction industry constructs many dwellings and buildings which are backfilled with whatever earth is nearby.

In the past few years, several attempts have been made to solve the problem of preventing the clogging of drainage channels in subterranean panels. Usually, these involve the use of two or more layers of materials. For example, in Canadian patent 1,158,054 (Pate), a water permeable synthetic resin strainer film is secured to the backing plate across the drainage channels to permit water to move to the channels without allowing dirt to enter the channels.

Again, in Canadian patent 1,202,190 (Sartor), a water pervious film is located at least on one side of the panel to prevent entry of the soil particles into the drainage grooves.

In Canadian patent 1,229,993 (Cogliano), a three-part insulating barrier was constructed comprising a porous planar sheet having on one face a plurality of spaced open continuous channels; a non-porous adhesive sheet adhered to an opposite side; and a porous woven or non-woven fibrous cloth located on the channels.

In Canadian patent 1,001,863 (Saito), an intermediate non-woven fabric layer having fibres of high denier interconnected at their cross-points by a binder is used. Surface layers are attached to both sides of the non-woven fabric layer. The surface layers are porous, but thinner and spiral springs are inserted which produce vertical channels.

In Canadian patent 1,249,135 (Cogliano), a water permable panel for the exterior surface of the foundation is disclosed and claimed. The first surface has a plurality of pores which are less than 0.1 millimeters in diameter. Water passes from this first major surface to a second major surface, the second major surface being a plurality of spaced open continuous vertical channels. The patent also suggests that a fibrous material in the form of fibrous mat could be applied to one side of the panel.

In Canadian patent 1,220,041 (Larsson), drainage channels are covered by a web-like material which prevents clogging by the soil.

Finally, in Canadian patent 1,199,188 (Gemmell), at least one water permeable web is used on one side of a cuspated sheet.

All of the aforementioned inventions more or less attempt to solve the clogging problem, but none of them were found to be sufficiently effective. Moreover, all of the inventions require the use of two or more layers or types of material bound together thereby creating high cost of production.

It is therefore an object of the present invention to provide a one-piece molded panel made of one material which has both insulating qualities and drainage properties. It is a further object of the invention to provide drainage channels which are not clogged by the surrounding earth, i.e. backfill.

SUMMARY OF THE INVENTION

Therefore, this invention seeks to provide a one-piece molded insulating panel for use on exterior foundation walls; said panel constructed from expanded thermoplastics and comprising a plurality of vertically oriented first drainage channels on at least one face thereof; said first channels having narrow exterior openings on the face of the panel and thereafter increasing in size towards the interior of the panel such that when in operation said channels resist clogging from surrounding earth.

In a preferred embodiment, the panel has a plurality of second vertically oriented drainage channels on the second face of the panel, said channels being rectangular in shape; wherein in operation the second face of this said panel is adapted to abut the exterior foundation wall.

Preferrably, the first channels are in the form of bell-bottom grooves. A narrow slit extends from the exterior of the face of the panel and thereafter it enlarges to form a substantially round channel in the interior of the panel. These grooves are more or less self-cleaning and prevent the entry of the sub-soil, thereby preventing clogging of the grooves.

The panels are generally constructed of expanded polystyrene of approximately two to three inches in thickness. The polystyrene used has a low water vapor permeability.

The rectangular vertical channels on the inside of the panel which abut the foundation wall drain any excess water lying against the wall downwardly to a standard drainage tile at the foot of the foundation.

The panels have grooved ends so that they may be joined together secured in ship-lap fashion. The panels are also designed to prevent thermo bridging from the above ground portion of the wall. The panel extends upwardly as far as the floor joists or even above thereby avoiding the necessity of inside insulation around the floor joists. Four by eight sheets are the standard panel size, but any size can be manufactured by simply changing the mold. A 2 to 2½ inch thick panel has a compressive strength of 16 psi, a water vapor permeance of 2.8 perm-inch, and a thermo-resistance of R-8.

The above ground portion of the panels can be covered with a reinforced acrylic polymer parging coat. The panels are attached to the exterior face of the basement walls using asphalt adhesive pastes or plastic anchors.

BRIEF DESCRIPTION OF THE DRAWINGS

The invention will be described in detail in conjunction with the following drawings wherein.

DETAILED DESCRIPTION OF THE INVENTION

Figure 1:
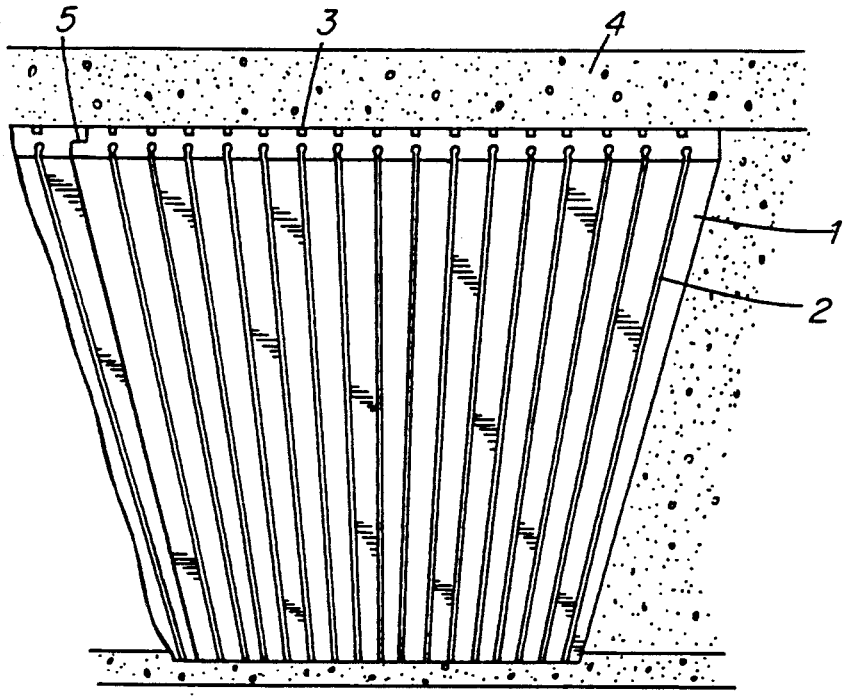
FIG. 1 is a perspective view of a panel of the present invention.

FIG. 1 has a panel 1 having a plurality of outside anti-clogging drainage grooves 2 and a plurality of inside rectangular drainage grooves 3. It abuts against the basement wall 4 and adjoins an adjacent panel at a joint 5.

Figure 2:
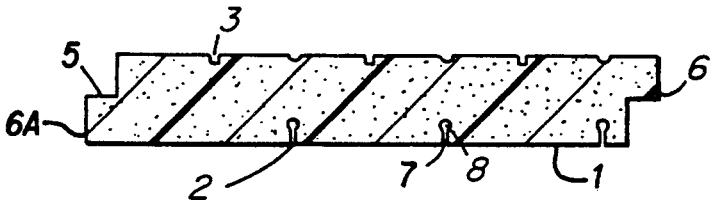
FIG. 2 is a cross-section of a preferred embodiment of the invention.

FIG. 2 is a preferred embodiment of the invention in cross-section. The panel has an end 6, anti-clogging drainage grooves 2 having a narrow slit area 7 and a round channel interior area 8. The opposite end 6A is conversely ship-lapped to join adjacent panels (not shown in FIG. 2).

Figure 3:
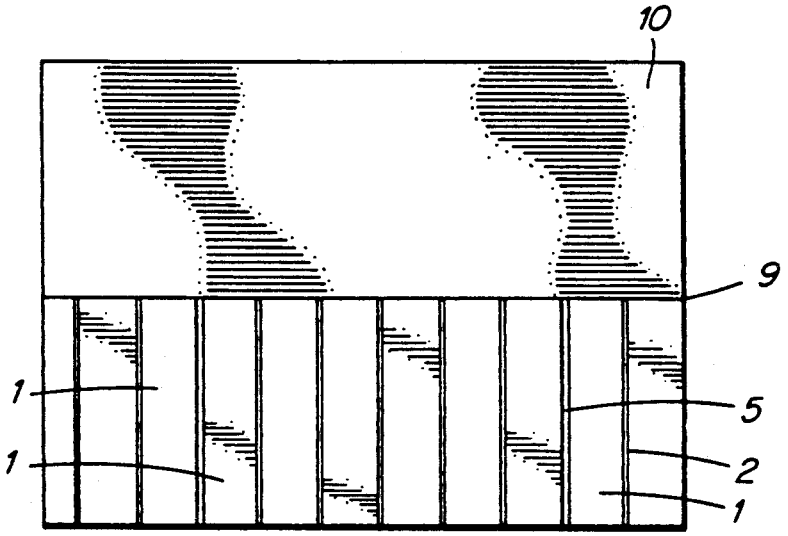
FIG. 3 is a face view of the invention showing that the above ground has been parged.

FIG. 3 is a face view of one panel of the present invention with two partial adjoining panels. Reference numeral 9 marks the ground level. The above ground portions 10 have been parged to resist the elements. Parging generally fills in the grooves or drainage channels as they are not required above ground.

Figure 4:
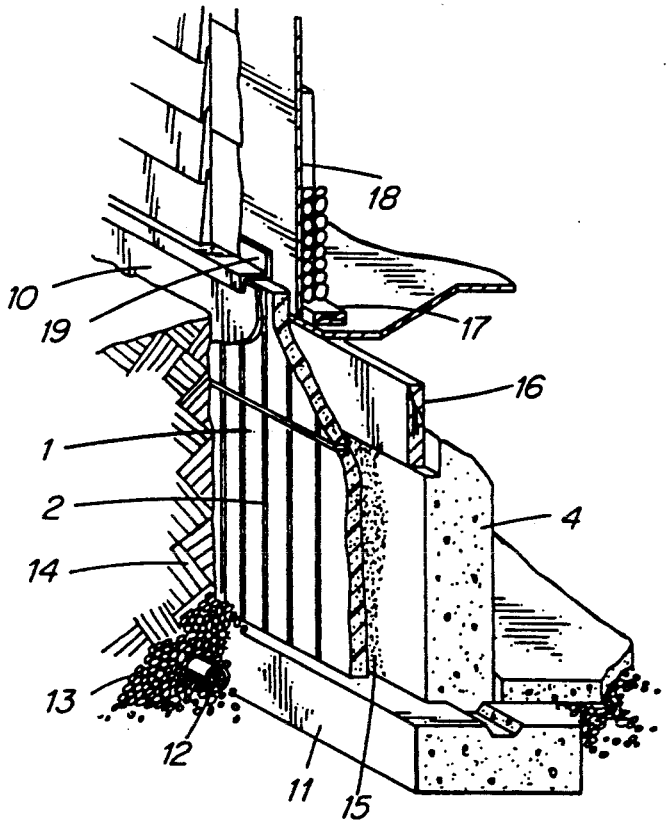
FIG. 4 is a perspective cut-away view of a basement wall with a panel o present invention applied.

In FIG. 4 one sees a cut-away view of a foundation wall and upper structure with the panel of the present invention in place. The panel 1 sits on the footing 11 adjacent the basement wall 4. Although not necessary the exterior of the wall 4 can be damp proofed 15 before application of the panel. The panel extends upward across the floor joist 16 past the wall stud 17 to the interior wall 18. A flashing 19 can be applied above the top of the panel and the portion above the ground can be parged 10. The ground water flows downward through the drainage grooves 2 and then into the aggregate 13 surrounding a standard drainage pipe 12. After installation, backfill 14 is placed against the panel.

Figure 5:
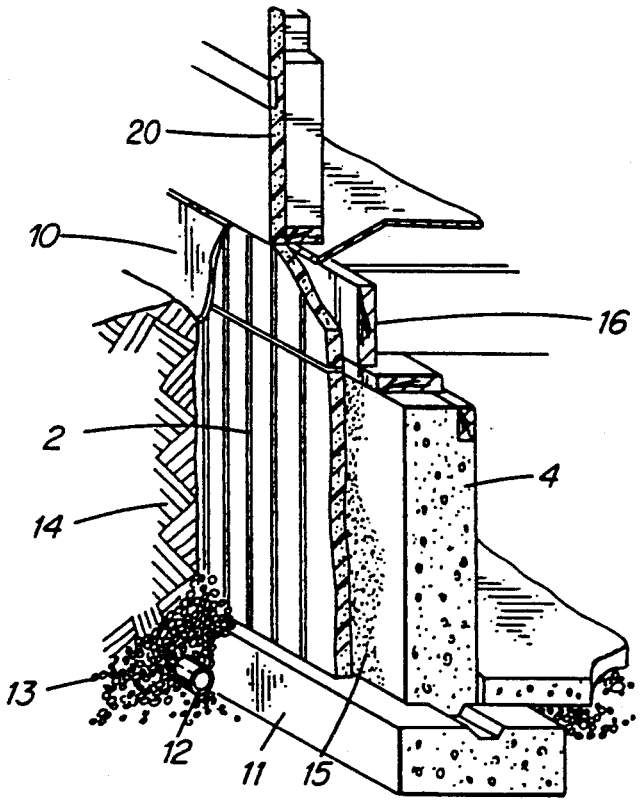
FIG. 5 illustrates the use of the panel in conjunction with outer insulation used on the above ground walls.

In FIG. 5, one notes that the panel 1 rises upwardly and meets an above ground standard insulation panel 20 thereby completely insulating the exterior of the home from the above ground level to the footing.

It should be noted that the present invention is not restricted to the embodiments described herein but comprises any insulating panel which falls within the spirit of the invention.

What I claim as my invention is:

1. In a building construction having a one-piece molded insulating member for direct engagement with exterior foundation walls and adapted to be directed engaged by backfill earth, the improvement comprising;

a panel constructed from expanded thermoplastics exhibiting low water vapor permeability and having opposite first and second faces with said first face engageable with backfill earth and said second face adapted to abut a foundation wall, said first and second panel faces respectively provided with a plurality of vertically disposed laterally spaced apart first and second drainage channels, said first channels having narrow exterior openings on said panel first face communicating with enlarged openings towards the interior of said panel, said second channels defining a substantially rectangular configuration in cross-section, said first channels defining a depth of at least ⅔ inch and said second channels defining a depth of at least ⅜ inch, said panel having opposite ends respectively provided with offset L-shaped grooves to allow the adjacent secure connection between a plurality of said panels, whereby said first channel exterior openings resist clogging from directly engaging surrounding earth while allowing passage of water into said first channel enlarged openings for drainage while said second channels freely allow drainage of any water reaching said panel second face abutting the foundation wall.

2. A one-piece molded insulating member according to claim 1 wherein, said first drainage channel exterior openings comprise a narrow slit and said first drainage channel enlarged openings define a substantially round configuration, whereby said first drainage channels define the form of bell-bottom grooves.

3. A panel as claimed in claim 1, wherein said panel is constructed of expanded polystyrene.

* * * * *